US006190466B1

(12) United States Patent
Apagyi et al.

(10) Patent No.: US 6,190,466 B1
(45) **Date of Patent: *Feb. 20, 2001**

(54) NON-SAG TUNGSTEN WIRE

(75) Inventors: Jozsef Apagyi, Dunakeszi; Istvan Meszaros; Gyorgy Nagy, both of Budapest, all of (HU); Robert J. Arena, Novelty; Milan R. Vukcevich, University Heights, both of OH (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/784,115

(22) Filed: Jan. 15, 1997

(51) Int. Cl.[7] ..... C22C 27/04
(52) U.S. Cl. ..... 148/423; 75/235; 420/430; 313/315
(58) Field of Search ..... 148/423, 514; 75/235; 420/430; 313/315

(56) References Cited

U.S. PATENT DOCUMENTS

| | | | | |
|---|---|---|---|---|
| 1,602,526 | * | 10/1926 | Gero | 148/423 |
| 1,826,514 | * | 10/1931 | Gero et al. | 148/423 |
| 2,825,703 | * | 3/1958 | Conant | 148/423 |
| 3,927,989 | | 12/1975 | Koo . | |
| 4,923,673 | * | 5/1990 | Litty | 419/20 |
| 5,284,614 | * | 2/1994 | Chen et al. | 419/20 |
| 5,590,386 | * | 12/1996 | Patrician et al. | 419/20 |
| 5,742,891 | * | 4/1998 | Patrician et al. | 419/4 |

FOREIGN PATENT DOCUMENTS

| | | |
|---|---|---|
| 1004281 | 1/1977 | (CA) . |
| 0 456 054 A2 | 4/1991 | (EP) . |

* cited by examiner

*Primary Examiner*—John Sheehan
(74) *Attorney, Agent, or Firm*—Fay, Sharpe, Fagan, Minnich & McKee, LLP

(57) ABSTRACT

The invention relates to non-sag tungsten wire for being used in light sources or heating elements, which tungsten wire is prepared from a tungsten block by powder metallurgy process with thermomechanical technique, and has an overlapped crystal structure after recrystallization and contains a dopant material. The essential feature of the tungsten wire according to the invention is that as the dopant material, it contains at least one of the following additive materials: lanthanum/III/oxide,
cerium dioxide.

5 Claims, No Drawings

NON-SAG TUNGSTEN WIRE

The invention relates to a non-sag tungsten wire used in light sources or heating elements, which tungsten wire is prepared from a tungsten block by a powder metallurgy process with thermomechanical technique, and has an overlapped crystal structure after recrystallization and contains a dopant material. Recrystallization takes place during heat treatment or the first operation of the wire.

Incandescent lamp filaments and heating elements made from tungsten wires are expected to have good vibration resistance both in cold and in hot condition on one hand and good non-sag properties on the other.

It is well known from the literature (see e.g. E. Pink, L. Bartha: The Metallurgy of Doped/Non-sag Tungsten, Elsevier Appl. Sc.) that non-sag properties can be achieved by doping tungsten oxides with aluminium, potassium and silicon compounds. During this process, silicon and aluminium dopants evaporate while the sets of bubbles formed from the potassium vapor produce an overlapped recrystallized structure after heat treatment which structure ensures good non-sag properties, at the same time, however, vibration resistance not always reaches the desired level.

In order to increase vibration resistance, it is a usual method to use $ThO_2$ dopant material in 0.75–1.0% since in thoriated tungsten an equiaxial crystallite structure (i.e. a structure with no preferred orientation of crystal axes) is formed where the rapid migration of grain boundaries is prevented by the thoria particles on the grain boundaries, and due to this, tungsten wire will be made resistant to vibration; this type of tungsten wire, however, has a tendency to get deformed rapidly at high temperatures. Tungsten wires with this dopant have the disadvantages of having bad sag properties on one hand and of containing radioactive thorium on the other.

In order to combine the good properties mentioned, manufactures are experimenting various solutions. For example, a small percentage of rhenium is added to the tungsten doped with aluminium, potassium and silicon, which results in good non-sag properties together with good vibration resistance. Still, this solution has the disadvantage of being expensive and also, this type of tungsten is difficult to process (has poor workability).

The objective of the invention was to provide a solution that is able to combine the good properties mentioned and is able to eliminate the radioactive thorium and also produces tungsten wires with good workability at an acceptable price.

Based on our recognition, the stated objective can be achieved by a tungsten wire that contains lanthanum(III) oxide or cerium dioxide or a combination thereof. We have recognized that in cases when the tungsten is doped with lanthanum(III) oxide and/or cerium oxide in a determined quantity, the solid second phase being disintegrated in forging and drawing will, similarly to the bubbles of potassium vapor, prevent secondary recrystallization from occurring for a time, and then, above a certain temperature an abrupt grain growth—similarly to the case of potassium-doped tungsten—will take place, which results in an overlapped recrystallized structure similar to that of the aluminium-, potassium- and silicon-doped material.

In accordance with this, our invention is a non-sag tungsten wire for light sources or heating elements, which tungsten wire is prepared from a tungsten block by powder metallurgy process with thermomechanical technique, and has an overlapped crystal structure after recrystallization and contains a dopant material, and this dopant material contains at least one of the following additives:

lanthanum(III) oxide,
cerium dioxide.

We have found that by making use of lanthanum(III) oxide and/or cerium dioxide additives the objective set can be achieved most successfully in case of small additive concentrations, namely if the quantity of additive does not reach 0.6 weight percents and its value is preferably 0.475 weight percents or less.

We have found that the lower limit of additive quantity just ensuring the desired effect is 0.2, preferably 0.3 weight percents. wires with good properties. A further advantage of the tungsten wire according to the invention over those doped with aluminium, potassium and silicon is that its electron work function is substantially lower, which enables it to be used e.g. for cathodes in discharge lamps and cathode ray tubes as well.

In the following, our invention will be described in more details by means of examples.

As an example, the tungsten wire according to the invention can be produced as follows.

A tungsten block is made using the powder metallurgy process: the starting material is a doped tungsten compound, into which tungsten compound the dopant material is mixed in aqueous solution at room temperature, the mixture is then dried at 100 to 150 deg. C and reduced in a counterflow hydrogen-flushed furnace with a heating zone of 700 to 800 deg. C and the powder produced after reduction is pressed to have a rod with a cross-section of e.g. 12 mm×12 mm, the density of which is 10±0.5 g/cm$^3$. After this it is pre-sintered in a push-through furnace in hydrogen atmosphere, at 1200 to 1300 deg. C for about 15 minutes. This is followed by sintering using resistance heating and heat steps with the following heating time intervals: 15 minutes for ramp, 10 to 20 minutes for keeping at first heat step, 5–6 minutes for second ramp (heating further to second heat step), 20±10 minutes for second heat step and approx. 5 minutes for cooling. At the second heat step, sintering is made with a current value (approx. 4000 A) corresponding to 90 to 95% of melting-through current, while at the first heat step, about 70% of the current value used at the second heat step (i.e. approx. 2800 A) is applied. The tungsten block produced in this way containing additive with grain size below 3.5 sintering is made with a current value (approx. 4000 A) corresponding to 90 to 95% of melting-through current, while at the first heat step, about 70% of the current value used at the second heat step (i.e. approx. 2800 A) is applied. The tungsten block produced in this way containing additive with grain size below 3.5 microns is then formed to have a tungsten wire using a thermomechanical process including forging, intermediate recrystallizing heat treatment steps followed by drawing and, if required by the wire diameter, annealing heat treatment steps. Based on our experiences, the forging temperature to be used is preferably some 100 deg. C higher than in the case of aluminium-, potassium- and silicon-doped tungsten and a recrystallizing heat treatment is recommended after 30 to 35% of forging forming. In the drawing steps, in the case of wire diameters below 0.2 mm, an annealing heat treatment at 1100 to 1300 deg. C is preferably performed.

According to our invention, aqueous and an solution of lanthanum and/or cerium compound that will be converted into oxides in the manufacturing process, is added to the starting tungsten compound that can be ammonium paratungstate, blue tungsten oxide or some other tungsten oxide. The former compound can be preferably added as lanthanum nitrate and/or cerium nitrate.

Using the method described above, wires with a diameter of 0.4 mm were made with a thermomechanical process, forging and drawing from sintered tungsten rods with 12 mm×12 mm cross-section and containing $La_2O_3$ in 0.4 weight percents. Having measured the SAG property of the wires (according to JIS 4460—General Rules for Test of Tungsten and Molybdenum Materials), values of 10 to 16 mm were found; the corresponding values found for K-, Si-, Al-doped tungsten and $ThO_2$-doped tungsten were 7.5 to 13 mm and approx. 40 mm, resp. For the parameter characterizing resistance to vibration, i.e. the average of crystallite length to width ratios measured after recrystallization or L/W measure, values of 7 to 15 were obtained in case of the tungsten wire according to the invention, 7 to 10 in case of K-, Si-, Al-doped tungsten and 1 to 2 in case of 1% $ThO_2$-doped tungsten.

For tungsten containing 0.4 weight percent cerium oxide, the SAG values were found to be 11 to 14 mm and L/W ratios, 15 to 20.

For tungsten containing 0.4 weight percent lanthanum(III) oxide and cerium oxide in about fifty-fifty percents, the SAG values were found to be 15 to 18 mm and L/W ratios, 11 to 15.

Within our scope of protection, several kinds of tungsten wires can be made, therefore our invention is not limited to the examples described.

What is claimed is:

1. A light source including a non-sag tungsten wire, said wire being comprised of tungsten and having an overlapped crystal structure and including between greater than 0 and 0.475 weight percent lanthanum (III) oxide.

2. A non-sag tungsten wire for being used in light sources which tungsten wire has a diameter of less than 0.4 mm, has an overlapped crystal structure and contains between greater than 0 and 0.475 weight percent of lanthanum (III) oxide or cerium oxide.

3. The non-sag tungsten wire of claim 2, comprising between greater than 0 and 0.475 weight percent cerium oxide.

4. A non-sag tungsten wire for use in light sources, said tungsten wire having a diameter less than 0.4 mm and an overlapped crystal structure and containing between greater than 0 and 0.6 weight percent of the combined cerium oxide and lanthanum (III) oxide.

5. The light source of claim 4 comprising about 0.2 weight percent lanthanum (III) oxide and about 0.2 weight percent cerium oxide.

* * * * *